US005415072A

United States Patent [19]

Huang

[11] Patent Number: 5,415,072

[45] Date of Patent: May 16, 1995

[54] FOOT-PEDAL ENGAGING AND DISENGAGING MECHANISM OF HIGH-HAT CYMBAL

[76] Inventor: Sen-Yung Huang, P.O. Box 1750, Tiachung, Taiwan, Prov. of China

[21] Appl. No.: 229,908

[22] Filed: Apr. 19, 1994

[51] Int. Cl.[6] ..... G10D 13/02
[52] U.S. Cl. ..... 84/422.3
[58] Field of Search ..... 84/422.3, 422.1, 421

[56] References Cited

U.S. PATENT DOCUMENTS 4,928,567 5/1990 Kurosaki ..... 84/422.3

*Primary Examiner*—M. L. Gellner
*Assistant Examiner*—Cassandra C. Spyron

[57] ABSTRACT

A foot-pedal device of a high-hat cymbal comprises a sleeve provided therein with a compression spring capable of forcing the upper cymbal of the high-hat cymbal to join intimately with the lower cymbal at such time when the foot-pedal mechanism of the high-hat cymbal is disengaged so as to permit a musician to strike the high-hat cymbal with a stick for producing a variety of rhythmic accents.

1 Claim, 4 Drawing Sheets

FOOT-PEDAL ENGAGING AND DISENGAGING MECHANISM OF HIGH-HAT CYMBAL

BACKGROUND OF THE INVENTION

The present invention relates generally to a high-hat cymbal, and more particularly to the foot-pedal engaging and disengaging mechanism of the high-hat cymbal.

As shown in FIG. 1, a conventional high-hat cymbal is generally composed of a pair of opposed cymbals mounted on a metal stand and struck together by a foot-pedal mechanism involving an engaging and disengaging structure 10, such as a retaining hook 101 for catching a tube 102 to which the upper cymbal is fastened. The up-and-down reciprocating motion of the upper cymbal is made possible by a connection rod which is actuated by the foot-pedal mechanism, thereby enabling the two opposed cymbals to be struck together to produce a variety of metallic sounds and rhythmic accents.

Such a prior art high-hat cymbal as described above is defective in design in that the retaining hook 101 must be caused to disengage the tube 102 at such time when the high-hat cymbal is to be used by a drummer, who is expected to strike the cymbal with a drumstick. The disengaged tube 102 is then free to move downwards to permit the two opposed cymbals of the high-hat cymbal to stack together. It is often difficult for the drummer to produce a desired rhythmic accent by striking the stacked cymbals with a drumstick in view of the fact that the two opposed cymbals are not stacked together intimately and that there is a small gap between the two stacked cymbals.

In addition, it is a common practice that a drummer uses a drumstick to hit a disengaging rod 103 to bring about the disengagement of the retaining hook 101 with the tube 102. However, the disengaging rod 103 is disposed in an awkward location that it can not be struck conveniently by the drummer with a drumstick.

Moreover, the distance separating the two opposed cymbals of the prior art high-hat cymbal can not be adjusted in accordance with the leg length of a musician.

SUMMARY OF THE INVENTION

It is therefore the primary objective of the present invention to provide a foot-pedal engaging and disengaging mechanism of a high-hat cymbal with a compression spring enabling the two opposed cymbals of the high-hat cymbal to stack together intimately at such time when the foot-pedal mechanism is disengaged.

It is another objective of the present invention to provide a foot-pedal mechanism of a high-hat cymbal with a disengaging rod which is conveniently located to permit a musician to disengage the disengaging rod with a stick.

It is still another objective of the present invention to provide a foot-pedal mechanism of a high-hat cymbal with means enabling a musician to adjust the distance between the two opposed cymbals of the high-hat cymbal in accordance with his or her requirement.

The foregoing objectives of the present invention are attained by a foot-pedal device provided with a sleeve having therein a compression spring capable of forcing the upper cymbal to join intimately with the lower cymbal at such time when the foot-pedal mechanism of the high-hat cymbal is disengaged.

DETAILED DESCRIPTION OF THE INVENTION

Figure 1:
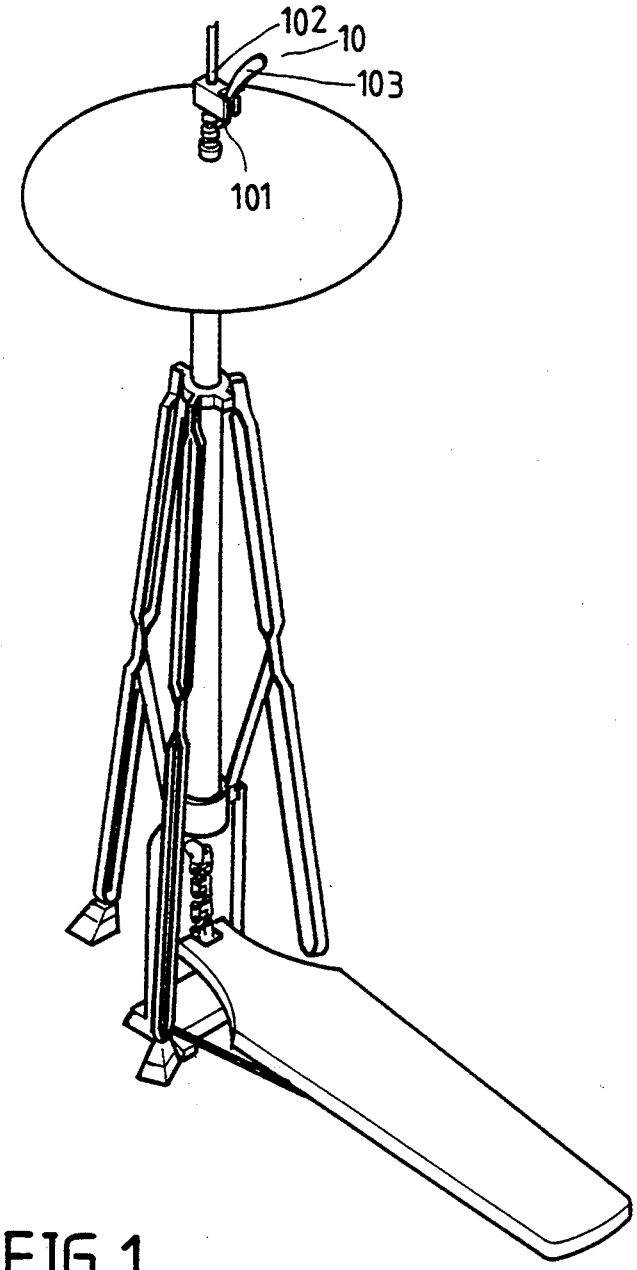
FIG.1 PRIOR ART
FIG. 1 shows a perspective view of a high-hat cymbal of the prior art.
Figure 2:
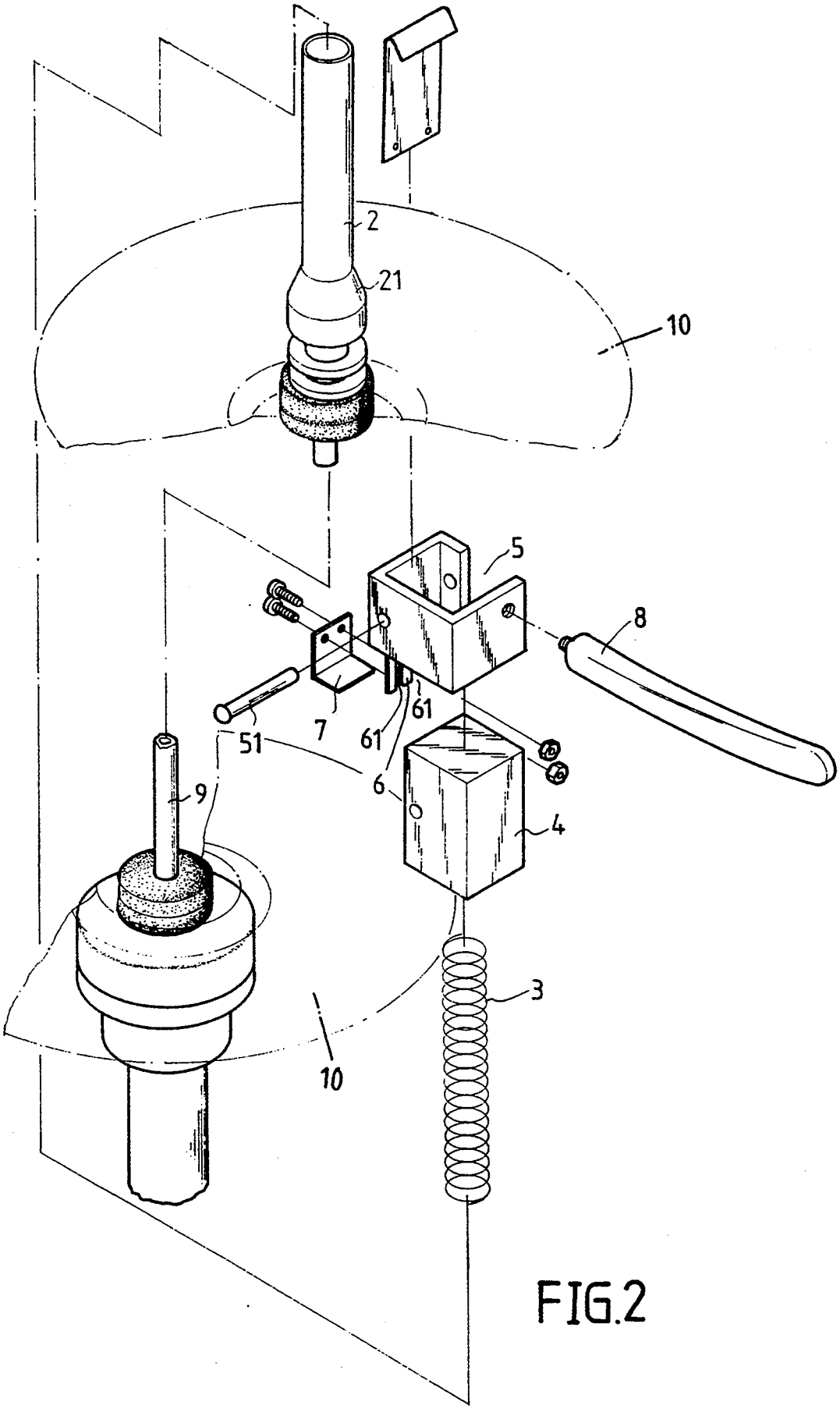
FIG. 2 shows an exploded view of the present invention.

As shown in FIG. 2, a foot-pedal device of a high-hat cymbal of the present invention comprises a sleeve 2, a compression spring 3, a main body 4, a frame 5, a locating member 6, a retaining member 7 and a disengaging rod 8.

Figure 3:
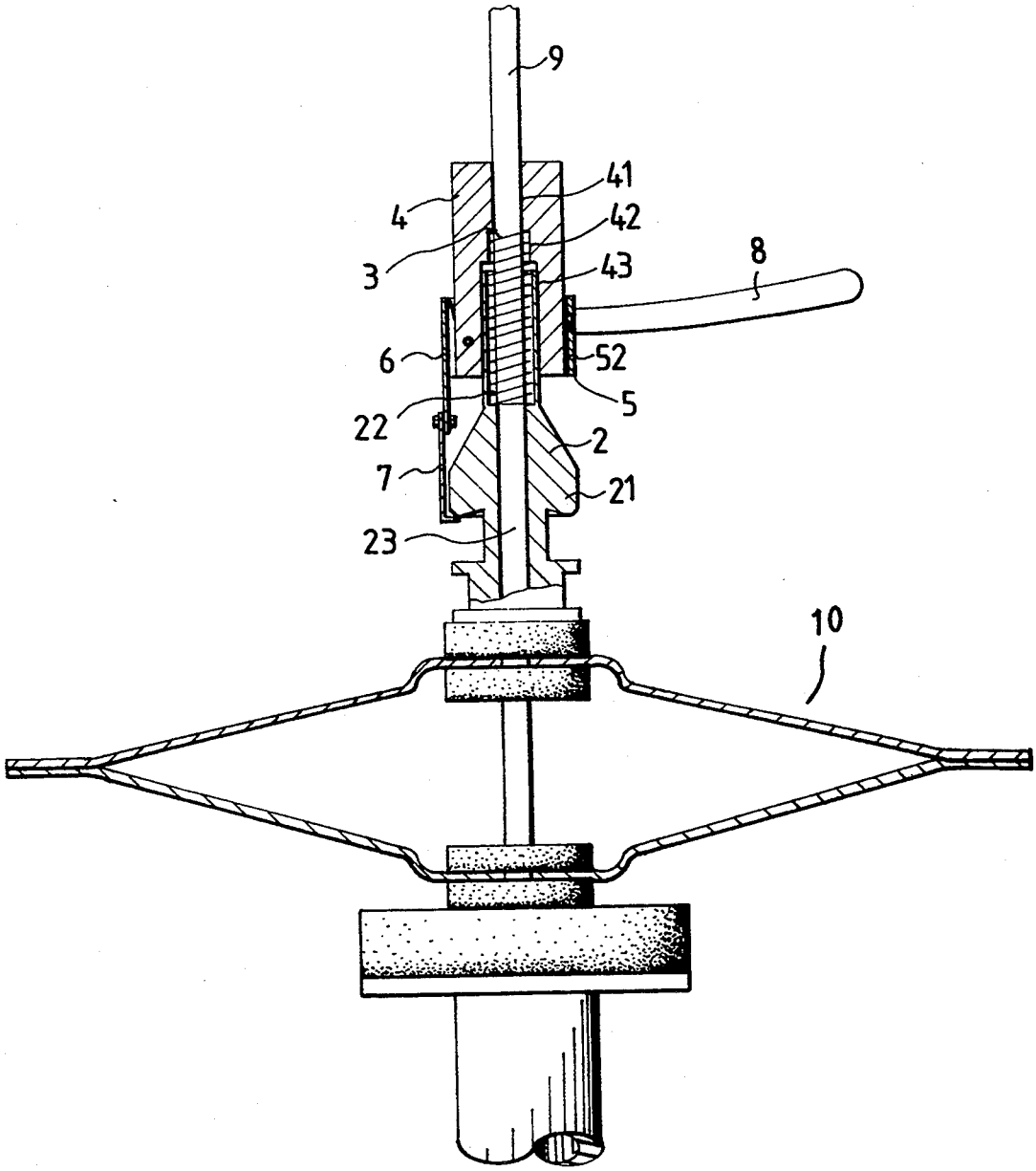
FIG. 3 shows a longitudinal sectional view of the present invention.
Figure 4:
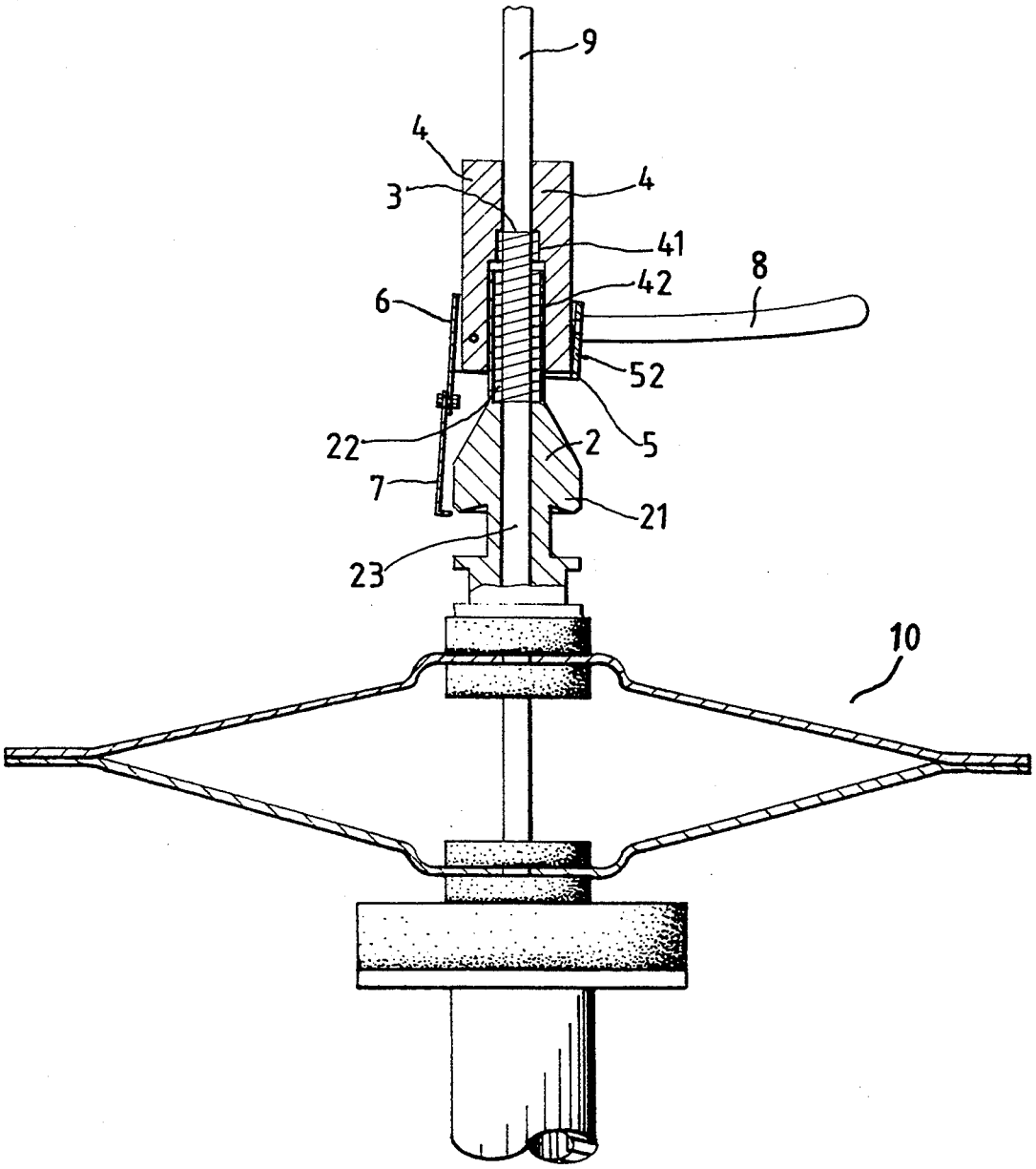
FIG. 4 shows a longitudinal sectional view of the present invention in a disengaging state.

The sleeve 2 is fastened at one end thereof with an upper cymbal 10 of the high-hat cymbal and is slidably mounted on a shaft 9. The sleeve 2 is provided integrally on the circumference thereof with a tapered flange 21. As shown in FIG. 3, the sleeve 2 is provided therein with two holes 22 and 23 of different inner diameters, with the hole 22 having a greater inner diameter.

The compression spring 3 is fitted over the shaft 9 such that a portion of the compression spring 3 is received in the hole 22.

The main body 4 is provided therein with three through holes 41, 42 and 43, which are different in inner diameter from one another, with the through hole 41 having the smallest inner diameter dimensioned to fit over the shaft 9. The through hole 42 is dimensioned to receive therein the compression spring 3 while the through hole 43 is dimensioned to receive therein the sleeve 2.

The frame 5 is pivoted to the main body 4 by a pin 51 such that there is an appropriate gap 52 between the frame 5 and the main body 4.

The locating member 6 is fastened to the frame 5 and provided with a predetermined number of openings 61.

The retaining member 7 is adjustably fastened to the openings 61 of the locating member 6.

The disengaging rod 8 is fastened to the frame 5.

In operation, the tapered flange 21 of the sleeve 2 is retained by the retaining member 7 so as to keep the two opposed cymbals apart. The shaft 9 can be actuated by the foot pedal to cause the upper cymbal 10 to make an up-and-down reciprocating movement to produce with the lower cymbal a metallic sound. When the high-hat cymbal is expected to be used by a drummer with a drumstick, the upper cymbal 10 which is fastened to the sleeve 2 can be caused to join intimately with the lower cymbal by hitting upwardly with the drumstick the disengaging rod 8, which is then caused to actuate the frame 5 to swing slightly in the gap 52. The swinging of the frame 5 causes the retaining member 7 to disengage the tapered flange 21 of the sleeve 2, thereby permitting the upper cymbal 10 to join intimately with the lower cymbal by the elastic force of the compression spring 3.

In addition, the width of the gap between the two opposed cymbals of the high-hat cymbal can be adjusted at will by adjusting the positions of the retaining member 7 and the locating member 6.

The embodiment of the present invention described above is to be regarded in all respects as merely illustrative and not restrictive. Accordingly, the present invention may be embodied in other specific forms without deviating from the spirit thereof. The present invention is therefore to be limited only by the scope of the following appended claim.

What is claimed is:

1. A foot-pedal device of a high-hat cymbal comprising:

a shaft;

an upper cymbal;

sleeve mounted on said shaft such that said sleeve is fastened at one end thereof with said upper cymbal of a high-hat cymbal, said sleeve being provided integrally on a circumference thereof with a flange of a tapered construction, said sleeve being further provided therein with two through holes of different inner diameters;

a compression spring fitted over said shaft such that a portion of said compression spring is received in one of said two through holes of said sleeve;

a main body provided therein with three through holes of different inner diameters, a first of said three through holes being smaller in diameter than any other of said three through holes, a second of said three through holes being larger in diameter than any other of said three through holes, and a third of said three through holes being smaller in diameter than said second of said three through holes and larger in diameter than said first of said three through holes;

a frame pivoted by a pin to said main body such that there is an appropriate gap between said frame and said main body;

a locating member fastened to said frame and provided with a predetermined number of openings;

a retaining member adjustably fastened to said openings of said locating member such that said retaining member can engage or disengage said flange of said sleeve; and a disengaging rod fastened to said frame.

* * * * *